United States Patent [19]

Siegel et al.

[11] Patent Number: 4,811,439

[45] Date of Patent: Mar. 14, 1989

[54] METHOD OF MANUFACTURING FOAMED INNERSPRING UNIT AND PRODUCT

[76] Inventors: Edmond Siegel, 26 Warren Pl., Montclair, N.J. 07042; Nolan D. Gamble, 3417 Winfin Way, Carmichael, Calif. 95608

[21] Appl. No.: 898,294

[22] Filed: Aug. 20, 1986

[51] Int. Cl.[4] ..... A47C 27/15; A47C 27/20; B29C 67/22; B29C 39/10

[52] U.S. Cl. ..... 5/475; 5/478; 5/481; 264/46.4; 264/46.7; 264/46.9; 264/271.1; 264/275

[58] Field of Search ..... 264/46.7, 46.4, 275, 264/46.9, 271.1; 5/475, 478, 481

[56] References Cited

U.S. PATENT DOCUMENTS

| | | | |
|---|---|---|---|
| Re. 24,914 | 12/1960 | Koenigsberg | 264/46.5 X |
| 2,994,890 | 8/1961 | Wagner | 264/46.7 X |
| 3,049,730 | 8/1962 | Wall et al. | 3/351 |
| 3,081,487 | 3/1963 | Heffner et al. | 264/54 X |
| 3,099,021 | 7/1963 | Wetzler | 264/46.7 X |
| 3,216,849 | 11/1965 | Jacobs | 264/54 X |
| 3,239,584 | 3/1966 | Terry et al. | 264/46.7 |
| 3,325,834 | 6/1967 | Lovette et al. | 264/109 |
| 3,452,127 | 6/1969 | Lovette et al. | 264/113 |
| 3,920,609 | 11/1975 | Lehmann | 264/46.5 |
| 4,251,639 | 2/1981 | Jarre et al. | 521/159 |

*Primary Examiner*—P. Anderson
*Attorney, Agent, or Firm*—Blum Kaplan

[57] ABSTRACT

A method for producing a foamed innerspring unit using a foamable reaction mixture that will provide a flexible foam using diphenylmethane diisocyanate and at least one polyol is provided. The process comprises the steps of preparing the foamable reaction mixture, spraying the foamable reaction mixture into a tray, loading an innerspring unit into the foamable reaction mixture containing tray and permitting the foamable reaction mixture to rise to form a foam that is at least partially adhered to the unit. The process is especially well suited to be carried out on a continuous conveyor. A novel foamed innerspring unit is also provided.

20 Claims, 2 Drawing Sheets

METHOD OF MANUFACTURING FOAMED INNERSPRING UNIT AND PRODUCT

BACKGROUND OF THE INVENTION

This invention relates to foamed innerspring units and, in particular, to a method of manufacturing foamed innerspring units wherein a flexible polyurethane foam is adhered directly to an innerspring.

As used herein, the term "foamed innerspring unit" is intended to be construed in its broadest sense. In general, such foamed innerspring units include mattresses and box springs. A mattress is designed to provide support for a person sleeping thereon, while a box spring provides support for both the mattress and the person sleeping on the mattress. However, other types of "foamed innerspring units" such as cushions, car seats and the like can be provided in accordance with the invention and the term "foamed innerspring unit" is not intended to be limited only to mattresses and box springs.

Innerspring units formed of a unitary construction are known. For example, in U.S. Pat. No. 3,239,584 issued to Terry et al. on Mar. 8, 1966, a method of fabricating a seat or cushion using a combination construction of springs and resilient pads is shown. A spring wire element with an open mesh fabric placed thereon is used and a resilient foam is foamed through the open mesh fabric to bond the spring wire element, the open mesh fabric and the foam into a unitary structure. The structure is used primarily to manufacture seats for vehicles.

In U.S. Pat. No. 3,920,609 issued to Lehmann on Nov. 18, 1975, a method of producing a spring core mattress using coil springs that are at least partially embedded in coverplates is shown. The coverplates are positioned so as to be substantially parallel to each other while the coil springs are under a preload and are surrounded by foam material to hold them in their respective relative positions. The foam material is provided as foam sheets and is not foamed directly onto the coverplates.

U.S. Pat. No. 3,325,834 issued to Lovett et al on June 20, 1967 shows a method of making an innerspring body supporting article. The innersprings are embedded in adhering particles of multicellular resilient spongy material in order to provide a sturdy long-lasting resilient unitary structure. The particles of resilient spongy material are coated with an adhesive prior to being deposited and pressed into a mold. The innerspring structure is completely covered with the coated particles and a unitary structure is formed when the adhesive sets. A divisional application of this patent issued as U.S. Pat. No. 3,452,127 on June 24, 1969.

Other spring reinforced mattresses wherein a foam or other type of resilient material completely surrounds an innerspring are shown, for example, in U.S. Pat. Nos. 2,994,890 issued to Wagner on Aug. 8, 1961; 3,099,021 issued to Wetzler on July 30, 1963; and 3,049,730 issued to Wall et al on Aug. 21, 1962. Wall et al specifically relates to a seat structure wherein a first layer of polyurethane foam is used to embed a spring. A second layer of a less dense polyurethane foam is provided on top of the first layer of foam in order to provide increased comfort.

The polyurethane foams discussed in Wall et al are formed by reacting a polymeric material and a suitable organic polyisocyanate. The polymeric material can be a polyester or polyesteramide such as may be obtained by condensing a variety of polybasic acids, preferably dibasic acids such as adipic, sebacic, phthalic, oxalic, malonic, succinic, maleic, fumaric, itaconic and the like with polyalcohols such as ethylene glycol, diethylene glycol, glycerol, sorbitol and/or amino alcohols such as ethanolamine and amino propanol. Alkylene glycols and polyoxyalkylene glycols which may be used include ethylene glycol, propylene glycol, styrene glycol, diethylene glycol, polypropylene glycol and copolymers of these glycols. A high grade castor oil may also be used.

Suitable organic polyisocyanates include toluene 2,4 diisocyanate, toluene 2,6 diisocyanate and mixtures thereof, naphthalene 1,5 diisocyanate and M-phenylene diisocyanate and mixtures of these materials. The use of a toluene diisocyanate identifies the process as "TDI chemistry".

U.S. Pat. No. RE 24,914 issued to Koenigsberg on Dec. 20, 1960 discloses an innerspring foam mattress. The mattress assembly includes an innerspring and slabs of flexible polyurethane foam foamed around the terminal portions of the innerspring. The foam is made from a polyalkylether prepolymer that is prepared by reacting polyalkylether with excess 2,4-toluene diisocyanate. A foam is then prepared from the prepolymer.

As noted above, the Koenigsberg foam is prepared using "TDI chemistry". Materials prepared by TDI chemistry are flammable and emit toxic fumes. Additionally, foams prepared using TDI chemistry have a tough, inflexible skin. Accordingly, such materials are not desirable for use in a mattress and to the best of applicants' knowledge, the Koenigsberg mattress has never been commercially available.

In recent years, "MDI chemistry" foam has become available. MDI chemistry uses the reaction between methylene diphenyl disso-cyanates (also known as diphenylmethane diisocyantes) and a polyol to form a urethane foam. When urethane foams for use in the manufacture of mattresses and the like are prepared using MDI chemistry, the problems associated with the use of TDI chemistry can be overcome.

U.S. Pat. No. 4,251,639 issued to Jarre et al on Feb. 17, 1981 relates to the manufacture of flexible foams using MDI chemistry. Urethane-modified aromatic polyisocyanates are used to prepare the foam. These polyisocyanates are obtained by a reaction of a mixture of diphenylmethane diisocyanates and polyphenylene polymethylene polyisocyanates and have an NCO content of 15 to 30% by weight and a viscosity of 100 to 2000 centipoises at 20° C. The modified polyisocyanates are reacted with suitable hydroxyl compounds in a prepolymer or one-shot process in order to form flexible polyurethane foams having densities between about 20 and 150 grams per liter, the equivalent of between about 1.25 and 9.36 pounds per cubic foot.

The mixing of the components shown in Jarre et al can be accomplishing using conventional mixing equipment. For example, high pressure equipment which mixes the components of the foam at a pressure of between about 2,000 and 3,000 PSI can be used. Such equipment is extremely expensive and can cost upwards of $150,000 per machine.

Alternatively, low pressure mixing in a rotating mixer at a pressure of between about 50 and 100 PSI can be used. Such low pressure mixers comprise a cylinder with a mixing element that rotates at a speed of between about 4,000 and 8,000 rpm. This equipment is a bit less expensive than high pressure equipment and generally costs between about $50,000 and $100,000 per machine.

It is, therefore, desirable to provide a foamed innerspring unit that can be manufactured in a practical and continuous molding operation.

SUMMARY OF THE INVENTION

A method for producing a foamed innerspring unit in a continuous process using a foamable reaction mixture of at least diphenylmethane diisocyanate and a polyol is provided. The process comprises the steps of preheating a tray or mold cavity, spraying a release agent into the tray, spraying the foamable reaction mixture that will provide a flexible foam into the tray, loading an innerspring unit into the foamable reaction mixture containing tray, permitting the foamable reaction mixture to rise to form a foam and adhere to the unit, curing the foam and emptying and cleaning the tray. The process is especially well suited to be carried out on a continuous conveyor. A novel foamed innerspring unit is also provided.

It is, therefore, an object of the invention to provide a method of manufacturing a foamed innerspring unit in a continuous process using a foamable reaction mixture of at least diphenylmethane diisocyanate and a polyol.

Another object of the invention is to provide a method of manufacturing a foamed innerspring unit in a short period of time.

A further object of the invention is to provide a method of manufacturing a foamed innerspring unit at low cost.

Another object of the invention is to provide a method of manufacturing a comfortable foamed innerspring unit.

Still another object of the invention is to provide an inexpensive, comfortable and safe foamed innerspring unit.

Still other objects and advantages of the invention will in part be obvious and will in part be apparent from the specification.

The invention accordingly comprises the several steps and the relation of one or more of such steps with respect to each of the others, and the article possessing the features, properties and the relation of elements, which are exemplified in the following detailed disclosure, and the scope of the invention will be indicated in the claims.

DESCRIPTION OF THE DRAWINGS

For a fuller understanding of the invention, reference is had to the following description taken in connection with the accompanying drawings, in which.

DETAILED DESCRIPTION OF THE INVENTION

Figure 1:
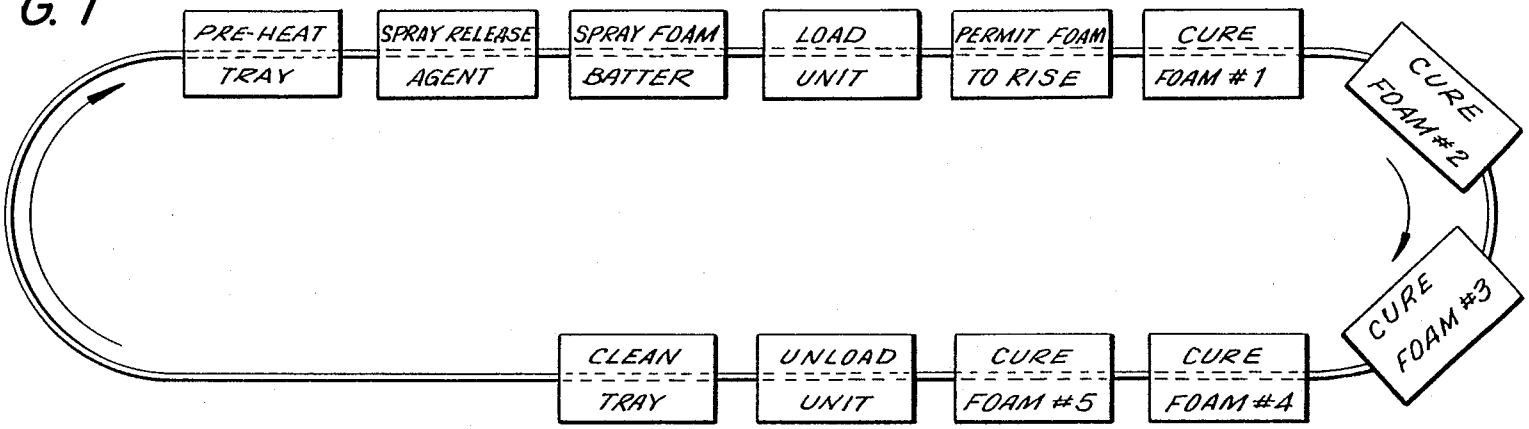
FIG. 1 is a flow diagram showing the steps of the method of the invention.

Referring to FIG. 1, a flow diagram showing the method steps for manufacturing foamed innerspring units in accordance with the invention is depicted. The method comprises the steps of preheating a tray, spraying a release agent into the tray, spraying a foamable reaction mixture of at least diphenylmethane diisocyanate and a polyol that will provide a flexible foam into the tray, loading an innerspring unit, permitting the foamable reaction mixture to rise to form a flexible foam and adhere to the unit, curing the foam and emptying and cleaning the tray. The process is especially well suited to be carried out on a continuous conveyor so that the cleaned tray is immediately preheated in preparation for a repetition of the method of the invention. In addition, multiple units of the same or different sizes can be processed simultaneously. The foamed innerspring unit prepared by the method described also comprises part of the invention.

Figure 5:
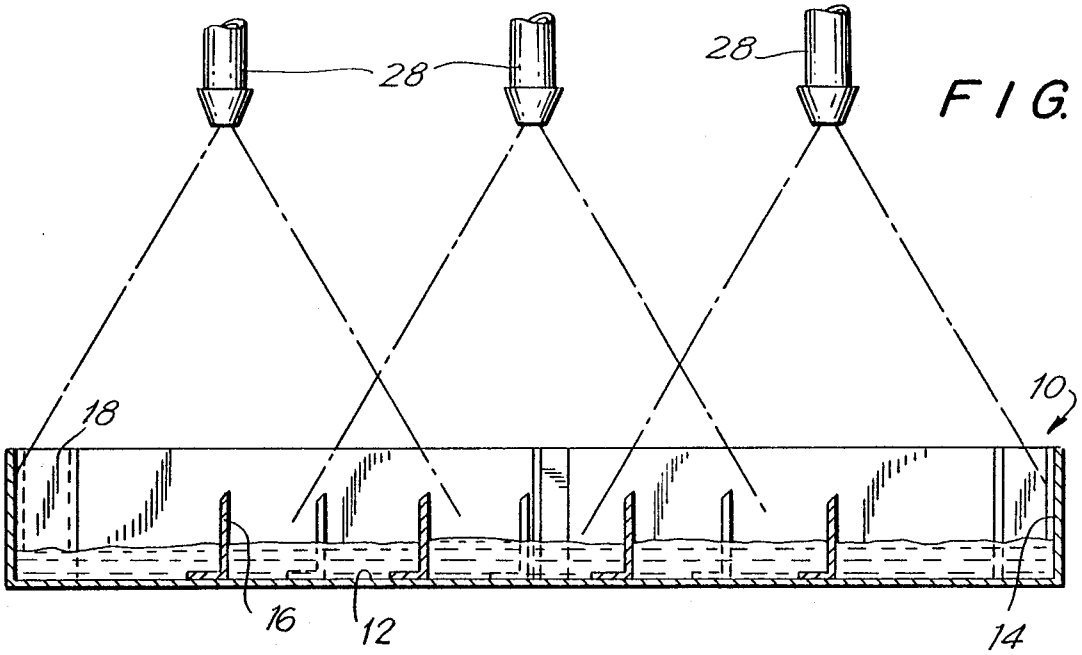
FIG. 5 is a diagram showing an overlapping foam spray used in the method of the invention.
Figure 6:
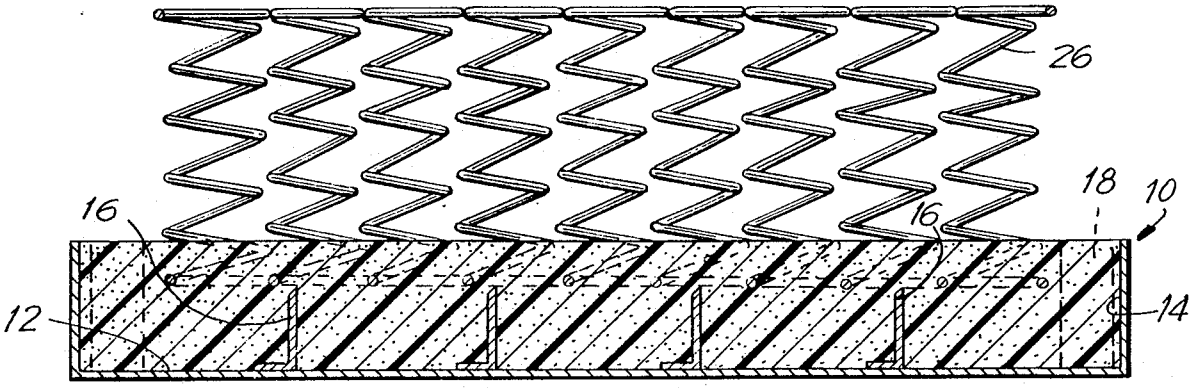
FIG. 6 is a cross-sectional view of a partially prepared foamed innerspring mattress of the invention.
Figure 4:
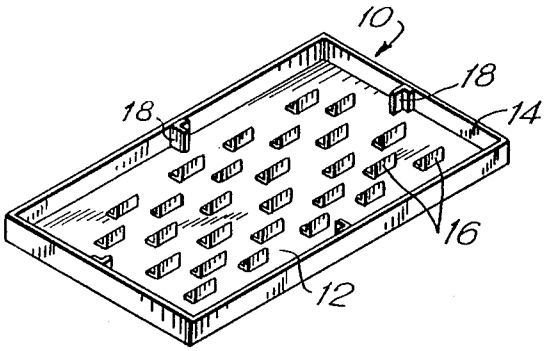
FIG. 4 is a perspective view of a tray used to prepare a foamed innerspring unit of the invention.

A tray or mold cavity 10 of the type adapted to be used to make foamed innerspring units of the invention is shown in FIG. 4 and, in cross-section, in FIGS. 5 and 6. The size and shape of the tray is not critical and is determined by the size and shape of the unit to be provided. In general, trays can be provided for any type of foamed innerspring unit such as mattresses, box springs, car seats, cushions and the like.

However, a primary object of this invention is to provide mattresses and box springs and these items are sold in standard sizes. Specifically, a twin size mattress is 75 inches long by 38 inches wide and requires a tray having dimensions of about 76 inches by about 39 inches. As another example, a queen size mattress or box spring is 80 inches long by 60 inches wide and the tray is required to be about 81 inches long by about 61 inches wide. In either case, the height of the foamed mattress or box spring is between about 7 and 8 inches and the height of the tray is between about 4 and 5 inches.

As shown in FIG. 4, tray 10 has a flat bottom 12 which defines a rectangular area. Four perpendicular sidewalls 14 define sides of tray 10. Stops 16 are riveted onto the bottom 12 of tray 10 in a spaced pattern. These stops define the height of the foam support that will extend above innerspring unit 26. In the case of a mattress or box spring, this height is generally between about ½ and 1½ inches and, more preferably, about 1 inch. It is to be understood that the spaced pattern shown in FIG. 4 is not intended to be limiting and as few or as many stops 16 as are necessary to maintain innerspring unit 26 a suitable distance (a) above bottom 12 of tray 10 can be used. In addition, stops 16 provide slits or openings 30 in foam layers 22 and 24 of foamed innerspring unit 20, as will be discussed in more detail hereinbelow.

In addition, guides 18 are secured to sides 14 of tray 10. Guides 18 can suitably be constructed of angles of aluminum and can be secured by rivets or any other suitable securing means. The purpose of the guides 18 is to center innerspring unit 26 in tray 10. Guides 18 extend approximately ½ inch into tray 10 from each sidewall 14, although this dimension can be adjusted as necessary depending upon the relative sizes of tray 10 and the innerspring unit 26.

The tray should be constructed of a suitable metal material. Suitable metal materials are those which retain heat for extended periods of time. An example of a suitable metal material includes, but is not limited to, steel.

In order to carry out the process of the invention, the tray is preheated to a temperature between about 100° and 120° F., and more preferably to about 110° F. In a preferred embodiment, the tray is preheated using infrared lamps. The purpose of preheating the tray is to allow the foamable reaction mixture to rise properly. If a foamable reaction mixture is poured into a cold metal tray, the mixture will not rise to its proper height since the metal tray will act as a heat sink and slow down the chemical reaction.

Either prior to or after preheating the tray, the tray is sprayed with a suitable release agent. Suitable release agents generally encompass long chain waxes dissolved in solvents. In particular, such agents include, but are not limited to, PARK 777® manufactured by Park Chemical Co, CHEM-TREND CT 1081® and CHEM-TREND CT 1057® manufactured by Chem Trend Corporation and HR 29® manufactured by Green Chem Products.

Once the tray has been preheated and sprayed with a release agent, it is ready to receive a foamable reaction mixture. The foamable reaction mixture used in accordance with the invention is prepared using diphenylmethane diisocyanate and at least one polyol without preparation of a prepolymer.

In general, the isocyanate is a blend of 2,4'-diphenylmethane diisocyanate and 4,4'-diphenylmethane diisocyanate. The isocyanates are present in an amount of greater than about 80% 4,4'-diphenylmethane diisocyanate and less than about 20% 2,4'-diphenylmethane diisocyanate. In an especially preferred embodiment, the blend includes greater than about 90% 4,4'-diphenylmethane diisocyanate and less than about 10% 2,4'-diphenylmethane diisocyanate.

The average isocyanate functionality refers to the average number of NCO groups attached to each molecule. In a preferred embodiment, the isocyanate functionality is between about 2 and 2.8. More preferably, the isocyanate functionality is between about 2.1 and 2.3.

The isocyanate equivalent weight refers to the molecular weight of an isocyanate molecule divided by the average isocyanate functionality. In a preferred embodiment, the isocyanate equivalent weight is between about 130 and 135.

Furthermore, in a preferred embodiment, the viscosity of the isocyanate mixture is between about 35 and 100 centipoises at 20° C. This low viscosity is desirable for purposes of the invention.

The polyol is a hydroxyl terminated copolymer. In a preferred embodiment, the polyol copolymer contains between about 14% and 20% ethylene oxide or propylene oxide and between about 80% and 86% of a polyether having a molecular weight of between about 4,000 and 6,000.

As pointed out in the Jarre et al patent cited herein above, a blowing agent such as water which reacts with th isocyanate mixture and provides carbon dioxide is required to foam the reaction mixture and this should be provided.

Catalysts which accelerate the polyurethane formation and, optionally, auxiliaries and additives, which are commonly used for the manufacture of flexible polyurethane foam, can also be added to the foamable reaction mixture. Auxiliaries and additives include, for example, surface-active materials, flame inhibitors, pore regulators, antioxidants, hydrolysis-protection agents, dyes, fillers and other additives.

Suitable catalysts for accelerating the reaction between the polyols, the water, and optional chain-extension agents, on the one hand and the polyisocyanate mixture, on the other hand, include tertiary amines such as dimethylbenzylamine, N,N,N',N'-tetramethyldiaminodiethyl ether, bis-(dimethylaminopropy)-urea, N-methyl- or N-ethylmorpholine, dimethylpiperazine, 1,2-dimethylimidazole, 1-aza-bicyclo-(3,3,0)-octane, and preferably, triethylenediamine, metal salts such as lead octoate, tin, di-2-ethylhexanoate, and preferably, tin-(II) salts, and dibutyltin dilaurate, as well as, particularly, mixtures of tertiary amines and organic tin salts.

Preferably used are 0.5 to 5 percent by weight catalyst based on tertiary amines and/or 0.01 to 2.5 percent by weight of metal salts, based on the polyol weight.

Other possible materials to be used include surface-active substances which support the homogenization of the raw materials and which are also suited to regulate the cell structure of the flexible polyurethane foams. To be mentioned as examples are siloxaneoxyalkylene mixed polymer and other organic polysiloxanes oxyethylated alkylphenol, oxyethylated fatty alcohols, paraffin oils, castor oil or ricinoleic ester, and turkey red oil, which are used in quantities of 0.2 to 6 parts by weight per 100 parts by weight of the polyisocyanate mixture.

In order to improve the flame resistance, flame inhibitors are added to the flexible polyurethane foams manufactured in accordance with this invention. To be mentioned as examples are compounds containing phosphorus and/or halogen atoms which can also reduce the tendency toward brittleness of the products and function as plasticizers. These include tricresyl phosphate, tris-2-chloroethyl phosphate, tris-chloropropyl phosphate and tris-2,3-dibromopropyl phosphate, inorganic flame inhibitors such as antimony trioxide, arsenic oxide, ammonium phosphate, ammonium sulfate, and others, and preferably, cyanic acid derivatives such as cyanamide, dicyandiamide, guanidine, and in particular, guanidine salts, biguanidine, and particularly, melamine. Cyanic acid derivatives of the referenced type are described, for instance in U.S. patent application Ser. No. 28,663 filed Apr. 10, 1979. It has generally proven to be advantageous to use 5 to 70 parts by weight, preferably 10 to 50 parts by weight, of the above-referenced flame inhibitors per 100 parts by weight of the isocyanate mixture.

More detailed data concerning the above-mentioned other commonly used auxiliaries and additives are described in the literature, such as the monograph by J. H. Saunders and K. C. Frisch, "High Polymers", Volume XVI, Polyurethanes, Parts 1 and 2, Interscience Publishers, 1962 and 1964.

The polyol and the isocyanate are mixed in one step using suitable spray equipment. One example of suitable spray equipment is the Gusmer automatic mechanically self-cleaning high pressure spray gun. In particular, a model GX7 gun manufactured by Gusmer Corporation of Lakewood, N.J. is suitable. The spray gun has two inlet ports, a mixing chamber and an outlet. One of the inlet ports is adapted to receive the polyol while the other is adapted to receive the isocyanate. A high pressure proportioner such as the model H-2000 high pressure proportioner also manufactured by Gusmer Corporation can be used to adjust the ratio of polyol to isocyanate entering the inlet ports. The polyol and isocyanate are mixed rapidly in the mixing chamber to form a foamable reaction mixture. The foamable reaction mixture is dispensed through the outlet in an appropriate pattern prior to the time the reaction mixture begins to foam.

The spray equipment used to carry out the method of the invention is commonly used in the construction industry for manufacturing and spraying rigid foams, roof insulation, thin layer coatings and the like. The equipment costs only about $15,000 and is, therefore, inexpensive, portable, easy to handle and transport and mixes the components of the spray under high pressure. However, only one setting is available for each gun. Conventional high or low pressure mixing equipment for mixing flexible foams generally has variable settings so that the isocyanate equivalent weight can be adjusted as necessary by changing the pump speed.

The spray equipment used to carry out the process of the invention places limitations on the chemistry. Usually, MDI chemistry proceeds using about a 1:1 ratio of isocyanate:polyol. However, in order to prevent clogging of the spray gun due to premature foaming, it is necessary to adjust the ratio to about 1 part isocyanate per 2 parts polyol.

The resulting foam has a density of between about 2.0 and 2.5 lbs/ft$^3$, preferably, between about 2.0 and 2.2 lbs/ft$^3$. In contrast, foam prepared using TDI chemistry has a density on the order of about 1.2 lbs/ft$^3$. A foam having a density of between about 2.0 and 2.5 lbs/ft$^3$ has about twice as much chemical composition per cubic foot of foam as a foam having a density of 1.2 lbs/ft$^3$ and, correspondingly, less air in the foam. Foams prepared in accordance with the invention are, therefore, attractive from the point of view of weight and cost. A foam having a density within the preferred range will provide a firm and comfortable mattress. Additionally, foams prepared using MDI chemistry do not have tough, inflexible skins on the side adjacent the tray.

A dense foam of the type prepared in accordance with the invention will return to its original configuration or, at the least, nearly its original configuration after it has been compressed and the compression force has been withdrawn, i.e. the foam exhibits elastic deformation. This is a desirable characteristic for a foam used to prepare a foamed innerspring unit. Less dense foams exhibit plastic deformation and this is undesirable.

The nozzle 28 of the specialized spray gun used in accordance with the invention sprays the foamable reaction mixture in a straight line fan pattern as shown in FIG. 5. The foamable reaction mixture is sprayed into the tray to an appropriate depth. The depth of spray is determined by the height that the foam is to be permitted to rise. In general, the foam rises to about five times the height to which it is sprayed. Alternatively, the spray pattern can be an oval pattern.

In a preferred embodiment, the fan spray has a width of 24 inches. Accordingly, the spray gun is traversed over the tray in order to fill the tray to the predetermined depth. In an alternate embodiment, multiple spray guns can be used and, in a still further alternate embodiment, the spray gun can be maintained stationary and the tray can be moved as necessary. It is to be noted that the most difficult area to cover are the edges of the tray and accordingly, an especially heavy spray is required in these areas. This may be achieved by having a portion of the foam pattern impact on the sidewalls of the tray as shown in FIG. 5.

Since the edge of a mattress is a weak spot, torsion bars are usually provided in conventional mattresses in order to provide additional edge support. The torsion bars are arranged so that four are provided on each side and one on each end. The present invention contemplates that the edges can be built up laterally with foam so as to form a solid wall. This will provide continuous peripheral edge support and obviate the need for torsion bars.

In a preferred embodiment, five passes of the spray gun are required for filling the tray for a queen size mattress to a depth of 3/16 inch thick of foamable reaction mixture. Additionally, 3/16 inch batter will approximately quadruple in volume to provide a $\frac{3}{4}$ inch thick layer of foam.

It is not necessary to provide excess amounts of foam. Only sufficient foam is necessary to form a thin layer above the springs. In addition, it is only necessary to provide enough foam in the springs to adhere the foam to the springs. Use of excess foam is not desirable from the point of view of materials or cost.

A unit 26 is placed into the foamable reaction mixture while the foam is rising. In the case of a mattress, the unit may be a standard steel frame having a border wire, although the border wire is not essential. Pigtail-shaped spiral wires connect the coils together. The ends of the coils are knotted. Other types of steel frames are also within the contemplation of the invention and the invention is not intended to be limited in any respect by the type of steel frame that is used.

Prior to placing the innerspring in the foamable reaction mixture, the top and bottom of the innerspring unit can be wrapped with an open lightweight mesh. The mesh can be either a woven mesh or a mesh that has been extruded and stretched in a molten state. Preferably, the mesh is formed of nylon or polypropylene. The mesh serves as an insulator, as will be discussed in more detail hereinbelow.

In general, a chemical reaction to produce the foam is over within about 45–60 seconds. The foamed innerspring unit 26 is then cured at room temperature for a maximum additional period of less than about 15 minutes and, preferably, an additional period of about five to ten minutes, until it can be easily removed from tray 10. Alternatively, the foamed innerspring unit can be removed from the tray within about 4 minutes when heat is applied at a temperature of between about 110° and 120° F. for a period of about 3–4 minutes. In the case of a mattress, the partially foamed innerspring is turned over and foam is adhered to the other side using the above-described method.

Figure 3:
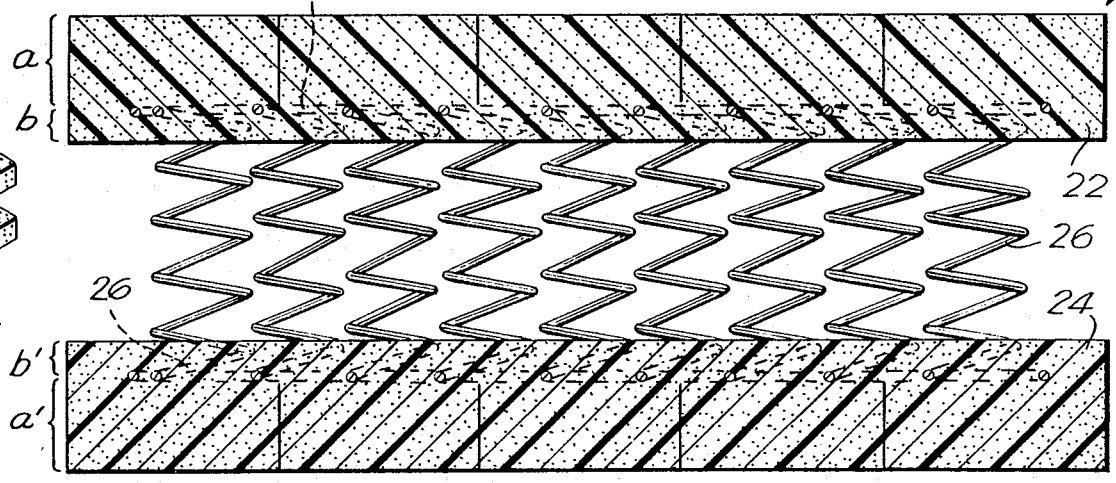
FIG. 3 is a cross-sectional view of the mattress of FIG. 2 taken through line 3—3 of FIG. 2.
Figure 2:
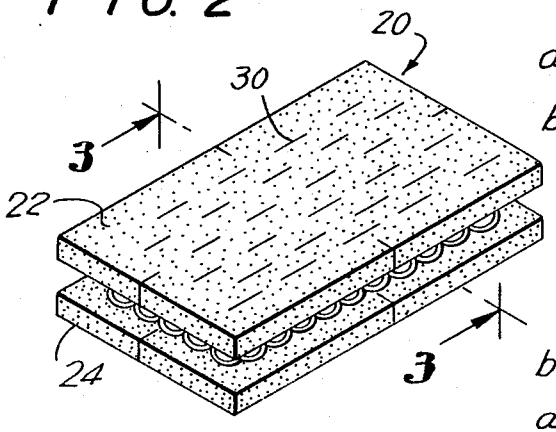
FIG. 2 is perspective view of a foamed innerspring mattress prepared in accordance with the invention.

A mattress 20 prepared in accordance with the invention is shown in perspective in FIG. 2 and in cross-section in FIG. 3. Mattress 20 has upper and lower foam layers 22 and 24, respectively, and coil innerspring 26. As shown in FIG. 3, upper and lower foam layers 22 and 24 extend only a short distance a and a', respectively, above and below the perimeters 28 of innerspring 26 so as to provide a protective foam pad. In addition, foam layers 22 and 24 extend into innerspring 26 only a sufficient distance b and b', respectively, to adhere the layers 22 and 24 to the spring 26. In general, in the case of a mattress or box spring, distance b and b' will be between about $\frac{1}{4}$ and $\frac{1}{2}$ inch. Accordingly, a comfortable foamed mattress 20 is prepared using a minimal amount of foam material.

Slits or openings in upper and lower foam layers 22 and 24, respectively, are created by stops 16 on bottom 12 of tray 10 when the foam is foamed onto innerspring unit 26. These slits or openings 30 are necessary for the proper functioning of upper and lower foam layers 22 and 24, respectively, when compression force is exerted thereon. The application of a compression force causes the foam to deform downwardly and outwardly. By providing slits or openings 30, the outward deformation of the foam extends only into the slits and not to the outer edges of the foamed innerspring unit 20.

The arrangement in accordance with the invention is not limited to use with an innerspring unit as shown in the drawings but other innerspring units can be used. For example, the innerspring unit can take the well known form of a group of springs each enclosed in a muslin enclosure, the respective muslin enclosures being sewn together, the group of springs being surrounded by a rim joined to the coils defining the edge of the group. In such a case, the foam bonds to the muslin enclosure and is selected to provide a softer texture to permit the individual displacement of one or several of the coils while holding the assembly together.

As can be seen, the non-flammable mattress provided in accordance with the invention by the addition of flame inhibitors to the components of foam is comfortable and long lasting. The coils are locked directly to the grid by the foam, providing a superior insulator. The high density foam provides a more buoyant and, therefore, more comfortable sleeping surface. In addition, since each coil is foamed directly to the grid of the unit, the foam serves as a noise insulator. Furthermore, this pre-foamed unit can be assembled into a finished mattress or boxspring at a greater speed than has previously been realized, thereby substantially reducing manufacturing costs.

It has been determined that the mattress of the invention is especially suitable for the hospital market. Hospital mattresses gatch, stretching normal foam out of shape. Gatching refers to the movement of a hospital bed and specifically, describes the position the bed assumes when it is upright. This results in lumps and weak spots in the mattress which contribute to bed sores on a patient lying therein. By adhering the foam of the invention to every steel point of the innerspring unit, stretching and resulting thin spots are reduced to a minimum. Accordingly, a more comfortable, longer-lasting mattress for the bedridden patient is provided.

It will thus be seen that the objects set forth above, among those made apparent from the preceding description, are efficiently attained and, since certain changes may be made in carrying out the above method and in the article set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A product prepared by a process comprising:

spraying a foamable, sprayable reaction mixture that will provide a flexible foam having a density of at least 2.0 lbs/ft$^3$ using diphenylmethane diisocyanate and at least one polyol into a tray by relatively displacing at least one nozzle and the tray to form a layer of the desired thickness in the tray;

positioning an innerspring unit in the foamable reaction mixture in spaced relation to the walls of the tray; and allowing the foamable reaction mixture to rise to form a foam that is at least partially adhered to one side of the innerspring unit so as to provide a foamed innerspring unit.

2. The product of claim 1, wherein the foamed innerspring unit is turned over and positioned for a second time in a tray containing a foamable reaction mixture that will provide a flexible foam using diphenylmethane diisocyanate and at least one polyol so as to form foam on the opposite side of the innerspring unit.

3. A method of manufacturing a foamed innerspring unit comprising:

preparing a foamable, sprayable reaction mixture that will provide a flexible foam having a density of at least 2.0 lbs/ft$^3$ using diphenylmethane diisocyanate and at least one polyol;

spraying the foamable reaction mixture into a mold cavity by relative displacement of at least one nozzle and the cavity to form a layer of the desired thickness in the cavity;

positioning an innerspring unit in the foamable reaction mixture in the mold cavity; and allowing the foamable reaction mixture to rise to form a flexible foam that is at least partially adhered to one side of the innerspring unit so as to provide a foamed innerspring unit.

4. The method of claim 1, wherein the tray has a flat rectangular bottom and four upstanding side walls and wherein a plurality of stops are secured to the flat bottom in a spaced pattern in such a way as to extend into the interior of the tray to support the innerspring unit in spaced relation to the tray bottom.

5. The method of claim 4, wherein the tray further comprises a plurality of guides secured to the sidewalls of the tray so as to extend into the interior of the tray to position the innerspring unit in spaced relation to the tray side walls.

6. The method of claim 1, wherein the tray is constructed of steel.

7. The method of claim 1, wherein the innerspring unit is a steel frame comprising a group of springs joined together in side-by-side relation.

8. The method of claim 7, wherein the frame further comprises upper and lower border wires joined respectively to the upper and lower regions of the peripheral springs.

9. The method of claim 6, wherein the springs are open to the foam and directly coupled to adjacent springs.

10. The method of claim 1, wherein the innerspring unit comprises a plurality of springs each of which is contained in a separate fabric pocket and wherein the fabric pockets are joined together in side-by-side relation.

11. The method of claim 9, wherein the innerspring unit further comprises upper and lower border wires secured to peripheral springs.

12. The method of claim 10, wherein the foam has a soft texture to permit relative displacement of the springs.

13. The method of claim 1, wherein the process is carried out on a continuous conveyor.

14. The method of claim 1, further comprising preheating the tray and spraying a release agent into the preheating tray prior to spraying the foamable reaction mixture into the tray.

15. The method of claim 1, wherein the foamable reaction mixture has a rise time of less than about 15 minutes.

16. The method of claim 15, wherein the foamable reaction mixture has a rise time of less than about 1 minute.

17. The method of claim 1, wherein the method further comprises curing the foam and removing the foamed innerspring unit from the tray.

18. The method of claim 17, wherein the foamed innerspring unit is turned over and placed for a second time into a foamable reaction mixture that will provide a flexible foam using diphenylmethane diisocyanate and at least one polyol containing tray so as to permit foam to adhere to at least the opposite side of the innerspring unit.

19. The method of claim 18, wherein a foamable reaction mixture spray is directed in part to at least a portion of the side walls of the tray for the purpose of building an edge in the foam projecting from said one side of said innerspring unit toward the other side thereof along the periphery thereof so that the edges in the foam meet along a substantial portion of each edge when the foam is adhered to both sides of the unit.

20. The method of claim 1, wherein a foamable reaction mixture spray is directed in part to at least a portion of the side walls of the tray for the purpose of building an edge in the foam projecting from said one side of said innerspring unit toward the other side thereof along the periphery thereof.

* * * * *